United States Patent [19]

Banyasz et al.

[11] Patent Number: 4,497,330

[45] Date of Patent: Feb. 5, 1985

[54] PROCESS FOR INCREASING THE FILLING POWER OF TOBACCO

[75] Inventors: Joseph L. Banyasz, Richmond; Cassandra D. Owens, Petersburg; Elizabeth D. Mooz, Richmond; A. Clifton Lilly, Jr., Richmond; Peter Martin, Richmond; Henry B. Merritt, Richmond; Bernard A. Semp, Richmond, all of Va.

[73] Assignee: Philip Morris Incorporated, New York, N.Y.

[21] Appl. No.: 395,473

[22] Filed: Jul. 6, 1982

[51] Int. Cl.[3] ..... A24B 3/18

[52] U.S. Cl. ..... 131/291; 131/292; 131/293; 131/294; 131/295; 131/296; 131/903

[58] Field of Search ..... 131/291, 292, 296, 293, 131/294, 300, 301, 295, 302, 303, 903

[56] References Cited

U.S. PATENT DOCUMENTS

| | | | |
|---|---|---|---|
| 1,789,435 | 1/1931 | Hawkins | 131/291 |
| 2,596,183 | 5/1952 | Sowa | 131/291 |
| 3,357,436 | 12/1967 | Wright | 131/303 |
| 3,742,961 | 7/1973 | Waller | 131/303 |
| 3,771,533 | 11/1973 | Armstrong | 131/291 |
| 3,842,846 | 4/1975 | Laszlo | 131/296 |
| 3,978,867 | 4/1976 | Wochnowski | 131/296 |
| 3,982,550 | 9/1976 | de la Burde et al. | 131/296 |
| 4,040,431 | 8/1977 | Ashworth et al. | 131/296 |
| 4,044,780 | 8/1977 | Kelly | 131/296 |
| 4,072,155 | 2/1978 | McGeady | 131/291 |
| 4,161,953 | 7/1979 | Glock | 131/291 |
| 4,195,647 | 4/1980 | Wochnowski et al. | 131/296 |
| 4,235,250 | 11/1980 | Utsch | 131/296 |
| 4,248,252 | 2/1981 | Lendvay et al. | 131/296 |
| 4,250,898 | 2/1981 | Utsch | 131/296 |
| 4,258,729 | 3/1981 | de la Burde et al. | 131/296 |
| 4,266,562 | 5/1981 | Merritt et al. | 131/296 |
| 4,336,814 | 6/1982 | Sykes et al. | 131/296 |

FOREIGN PATENT DOCUMENTS

| | | | |
|---|---|---|---|
| 0977235 | 11/1975 | Canada | 131/291 |
| 0980206 | 12/1975 | Canada | 131/291 |

*Primary Examiner*—V. Millin

[57] ABSTRACT

The present invention relates to a process for increasing the filling power of tobacco which comprises heating the tobacco at elevated temperature while maintaining the OV and SV values of the tobacco substantially constant. Preferably, the tobacco is heated at a temperature of at least about 80° C. in a closed system for a time sufficient to increase the CV value of the tobacco.

18 Claims, 5 Drawing Figures

SV=3.5
SV=3
SV=2.5
SV=2
SV=1.5
SV=1
357°C
343°C
316°C
288°C
2
3
1
130
120
110
100
90
80
70
60
50
40
30
9.4
9.8
10.2
10.6
11.0
11.4
11.8
12.2
12.6
C Veq (cc/10g)
O Veq (%)

▲ = ammonium carbamate process
● = WATER process
357°C
343°C
316°C
288°C
6
5
4
7
140
130
120
110
100
90
80
70
60
50
40
30
9.8
10.2
10.6
11.0
11.4
11.8
12.2
12.6
CVeq (cc/10g)
OVeq (%)

CV (cc/10g)
44.0
41.6
39.2
36.8
34.4
32.0
8
9
0
5
10
15
20
25
INPUT OV (%)

TREATMENT TEMPERATURE (°C)
204
177
149
121
93
66
38
0 1 2 3 4 5 6 7 8 9 10 11 12
t 1/2 (hours)

CVeq
t 1/2
HEAT TREATMENT TIME

PROCESS FOR INCREASING THE FILLING POWER OF TOBACCO

BACKGROUND OF THE INVENTION

The present invention relates to a process for increasing the filling power of tobacco. More particularly, the present invention relates to a process for increasing the filling power of tobacco at a substantially constant moisture content, that is, without substantially increasing or decreasing the moisture content of the tobacco during treatment.

During curing, the moisture content of tobacco leaves is greatly reduced resulting in shrinkage of the leaf structure and a decrease in filling power. Additionally, the shredding or cutting techniques generally employed to convert the cured tobacco leaves into filler may result in some lamination and compression of tobacco, thereby decreasing the filling power even further. Many processes have been devised for increasing the filling power of cured tobacco for reasons well known in the art.

The heretofore known processes may be broadly characterized as involving penetration or impregnation of the tobacco with impregnants (blowing or puffing agents) which when removed during a subsequent expansion process step generate elevated pressure in and expand the tobacco.

Among the impregnants which have been employed are pressurized steam, air, water, volatile organic liquids, ammonia, carbon dioxide, combinations of ammonia and carbon dioxide and compounds capable of liberating a gas when subjected to chemical decomposition, as by heating. Among the means disclosed for removing the impregnant to expand the cell walls are a sudden reduction in pressure, freeze-drying, convection heating, radiant transfer (infrared), and the application of a microwave field.

While a number of the known processes may be employed to provide a satisfactory, expanded tobacco product, which may then be blended with an unexpanded tobacco and formed into cigarettes or the like, the known processes do possess certain disadvantages. The use of certain impregnants, such as volatile organic liquids (e.g., freon), which are foreign to tobacco, may not be completely satisfactory because some of the materials employed are not always desired as additives and the introduction, in considerable concentration, of such foreign materials presents the problem of removing the excess expansion agent after the treatment has been completed in order to avoid affecting aroma and other properties of the smoke. Moreover, aside from the aforementioned disadvantages, the use of such foreign materials adds to the overall cost of producing tobacco end products.

The use of water as the impregnant is known. The earlier of the reported processes employing water as the sole impregnant tend to produce a more satisfactory result with tobacco stem than with tobacco lamina filler. One belief was that the lamina cellular structure was difficult to impregnate and that, therefore, most of the water remained on the surface. This belief may have motivated some of those skilled in the art to try vacuum impregnation and longer bulking times. More recent processes employing water as the sole impregnant have been successful in substantially increasing the filling power of tobacco lamina filler. Typically, in these processes, filler having a specific initial moisture content is subjected to rapid and uniform heat transfer which produces an expanded and stiffened filler having a relatively low moisture content. These processes, which may be viewed as involving dehydration of the filler, represent a significant advance in the art, but do require the establishment of critical initial moisture contents, the establishment and maintenance of the critical heat transfer parameters required to produce an expanded and stiffened filler having the essential, drastically reduced, post-treatment moisture content, and are generally accompanied by a significant loss of alkaloids, which may, in certain instances, be highly desirable. Discoloration and charring can occur when the various process parameters are not properly maintained.

Surprisingly, it has now been discovered that moisture elimination is not required during heat treatment in order to increase the filling power of tobacco and that heat treating the tobacco at a substantially constant moisture content can actually enhance filling power gain without loss of alkaloids. Additionally, since evaporation of water is not involved, the filling power gain can be realized at a lower energy expenditure.

DEFINITIONS

As used herein, the following terms have the indicated meanings.

Filling Power

The ability of tobacco to form a firm cigarette rod at a given moisture content. A high filling power indicates that a lower weight of tobacco is required to produce a cigarette rod of a given circumference and length than is required with a tobacco of lower filling power. Filling power is increased by stiffening tobacco and also by expanding tobacco.

Cylinder Volume (CV)

The volume that a given weight of shredded tobacco occupies under a definite pressure. The CV value is expressed as cc/10g. To determine this value, tobacco filler weighing 10.000 g is placed in a 3.358 cm diameter. cylinder and the cylinder vibrated for 30 seconds on a "Syntron" vibrator. The tobacco is then compressed by an 1875 g piston, 3.33 cm in diameter, for 5 minutes. The resulting volume of tobacco is reported as cylinder volume. This test is carried out at standard environmental conditions of 23.9° C. and 60% relative humidity (RH). A high cylinder volume indicates a high filling power.

Equilibrium Cylinder Volume ($CV_{eq.}$)

The cylinder volume determined after the tobacco has been equilibrated by conditioning at 23.9° C. and 60% RH, typically for 18 hours, although conditioning for 4 to 5 hours is also acceptable.

Oven-Volatiles Content (OV)

A value indicating the moisture content (or percentage of moisture) of tobacco filler. It is determined by weighing a sample of tobacco filler before and after treatment for three hours in a circulating air oven at 100° C. The weight loss as a percentage of initial weight is the oven-volatiles content. The weight loss is attributable to volatiles in addition to water but OV is used interchangeably with moisture content and may be considered equivalent thereto since, at the test conditions, not more than about 1% of the tobacco filler weight is volatiles other than water.

Equilibrium Oven-Volatiles Content ($OV_{eq.}$)

The OV value determined after the tobacco filler has been equilibrated by conditioning at 23.9° C. and 60% RH for 18 hours Specific Volume (SV)

The volume of a predetermined amount of tobacco divided by the weight of the tobacco. The SV value is expressed as cc/g. The "$SV_{acetone}$" value may be determined by a simple application of the weight in air versus weight in liquid method, according to which a one-gram sample of tobacco is placed in a porous container which is then weighed, submerged in acetone, and reweighed. The $SV_{Hg}$ value is determined by placing a known weight of tobacco in a sealed chamber of known volume and weight and then evacuating the air in the chamber to a pressure of 1 torr. An amount of mercury is then admitted to the chamber in a manner such that the interfacial pressure between the mercury and the tobacco limits the intrusion of mercury into the porous structure. The volume of mercury displaced by the tobacco sample of known weight at an interfacial pressure of 52 to 104 torr absolute is expressed as $SV_{Hg}$ in cc/g. Specific Volume differs from cylinder volume in that the tobacco is not compressed and in that the SV measurement excludes the inter-particle space or volume which contributes to the CV measurement. As specific volume increases, filling power also increases.

Equilibrium Specific Volume ($SV_{eq.}$)

The SV value determined after the tobacco filler has been equilibrated by conditioning at 23.9° C. and 60% RH for 18 hours.

Tobacco

This term is intended to include lamina filler, that is, shredded, cured tobacco exclusive of the stems (or veins) as well as reconstituted tobacco. The tobacco may be of any type, and may be cased or uncased. Burley, bright, Oriental and blends thereof are preferred. Also included are tobaccos which have been treated according to a known expansion process.

Exogenous Impregnant

A substance in solid, liquid or gaseous form, other than water, which is added to tobacco for its function as a blowing or puffing agent during an expansion step.

SUMMARY OF THE INVENTION

The present invention relates to a process for increasing the filling power of tobacco which comprises heating the tobacco at elevated temperature while maintaining the OV and SV values of the tobacco substantially constant. It is preferred to maintain the SV and OV values of the tobacco substantially constant by treating the tobacco in a closed system. Preferably, the tobacco is heated at a temperature of at least about 80° C. for a time sufficient to increase the CV value of the tobacco. Tobacco having an OV value within the range of from about 10% to about 16% is preferred, although tobacco having an OV value within the range of from about 4% to about 35% is effectively employed. The treated tobacco has a pleasing aroma and flavor and a virtually undiminished alkaloid content.

The present process may be used to increase the filling power of a wide variety of tobaccos and the tobacco employed is preferably selected from the group consisting of unexpanded bright, unexpanded cased bright, expanded bright, expanded cased bright, unexpanded Burley, unexpanded cased Burley, expanded Burley, expanded cased Burley, unexpanded Oriental, unexpanded cased Oriental, expanded Oriental, expanded cased Oriental, reconstituted tobacco and mixtures thereof. Where unexpanded tobacco is employed, the tobacco, once treated according to the present process, may, if desired, be expanded according to a known expansion process such as a water expansion treatment process (hereinafter, "a WATER process").

DESCRIPTION OF THE INVENTION

The present invention relates to a process for increasing the filling power of tobacco according to which tobacco is heated under conditions selected to maintain the moisture content of the tobacco substantially constant throughout the heat treatment. This process results in a stiffening of the tobacco which results in an increase in CV at substantially constant OV and SV values. Surprisingly, this result is achieved without the reduction in moisture content or dehydration disclosed to be an essential element of the prior art expansion processes. Unexpectedly, when unexpanded tobacco lamina filler is employed, the stiffened product may then be treated according to a conventional expansion process to expand the stiffened tobacco and increase its filling power even further.

Figure 1:
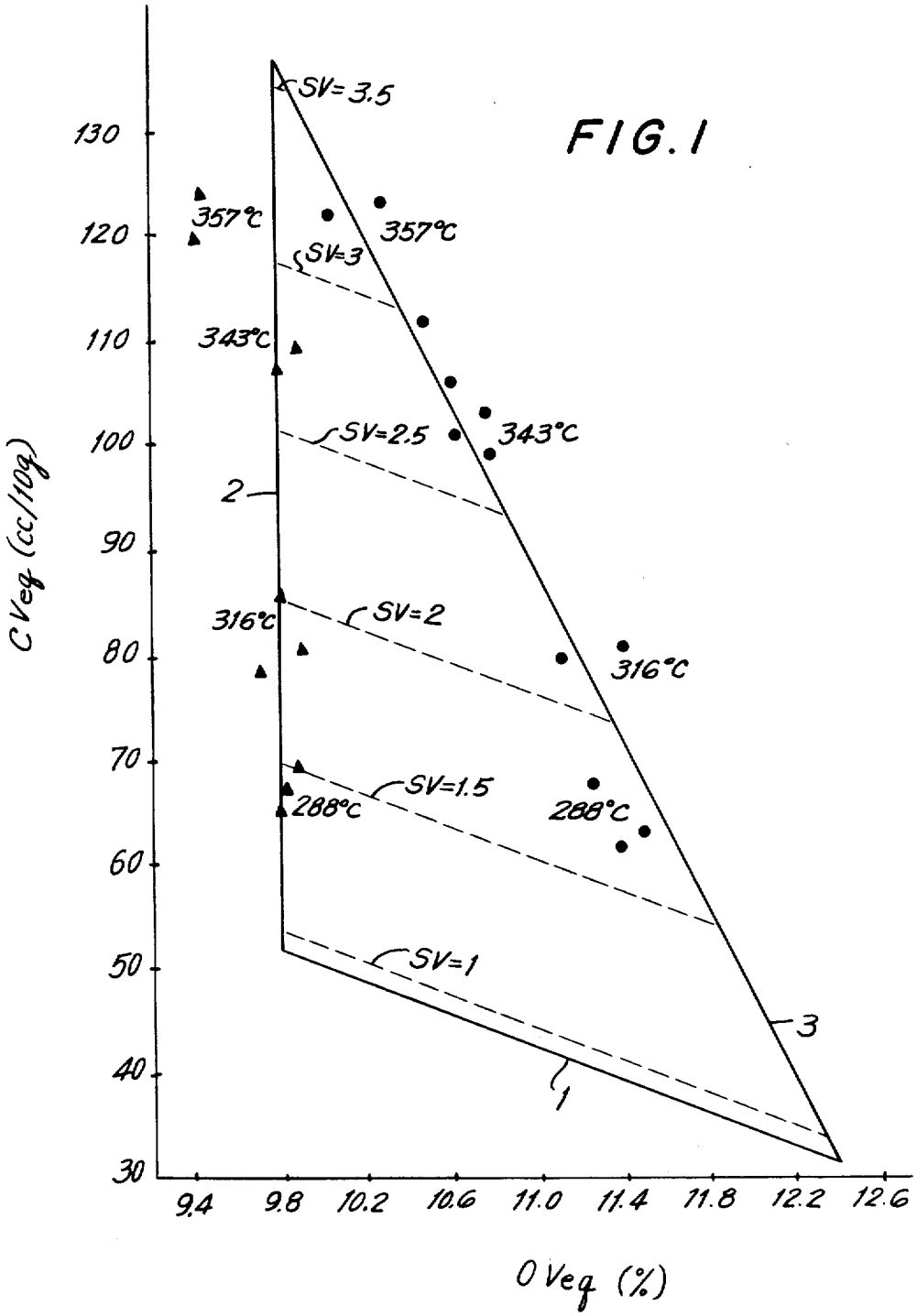
FIG. 1 is a diagram which shows the interrelationship of $CV_{eq}$, $OV_{eq}$ and SV for bright tobacco samples treated according to the process of the present invention (line 1), according to a WATER process (line 3) and according to a preferred embodiment of the present invention which includes a subsequent WATER process step (line 2).

As shown in FIG. 1, the process of the present invention, represented by line 1, results in a stiffening of the tobacco without an expansion effect as is indicated by the substantially constant SV value. This is confirmed by electron microscopy studies which do not reveal an increase in strand thickness or puffing of the epidermal cells. As indicated by line 2, the stiffened tobacco filler, which has not been expanded, may then be treated according to an expansion process, preferably a WATER process. The already stiffened tobacco may be expanded as is demonstrated by the increasing SV values.

Significant advantages are obtained according to the present process, which may be referred to as the substantially constant moisture treatment process, since it allows for the selection of a specific degree of stiffening of the tobacco and thus a specific degree of increase in filling power without dehydration, resulting in a product with increased filling power which has a pleasing aroma and flavor and which may not need to be reordered. Interestingly, the alkaloid content is only minimally decreased during treatment whereas the alkaloid content of tobacco treated according to one of the known expansion processes is greatly reduced during treatment.

Figure 2:
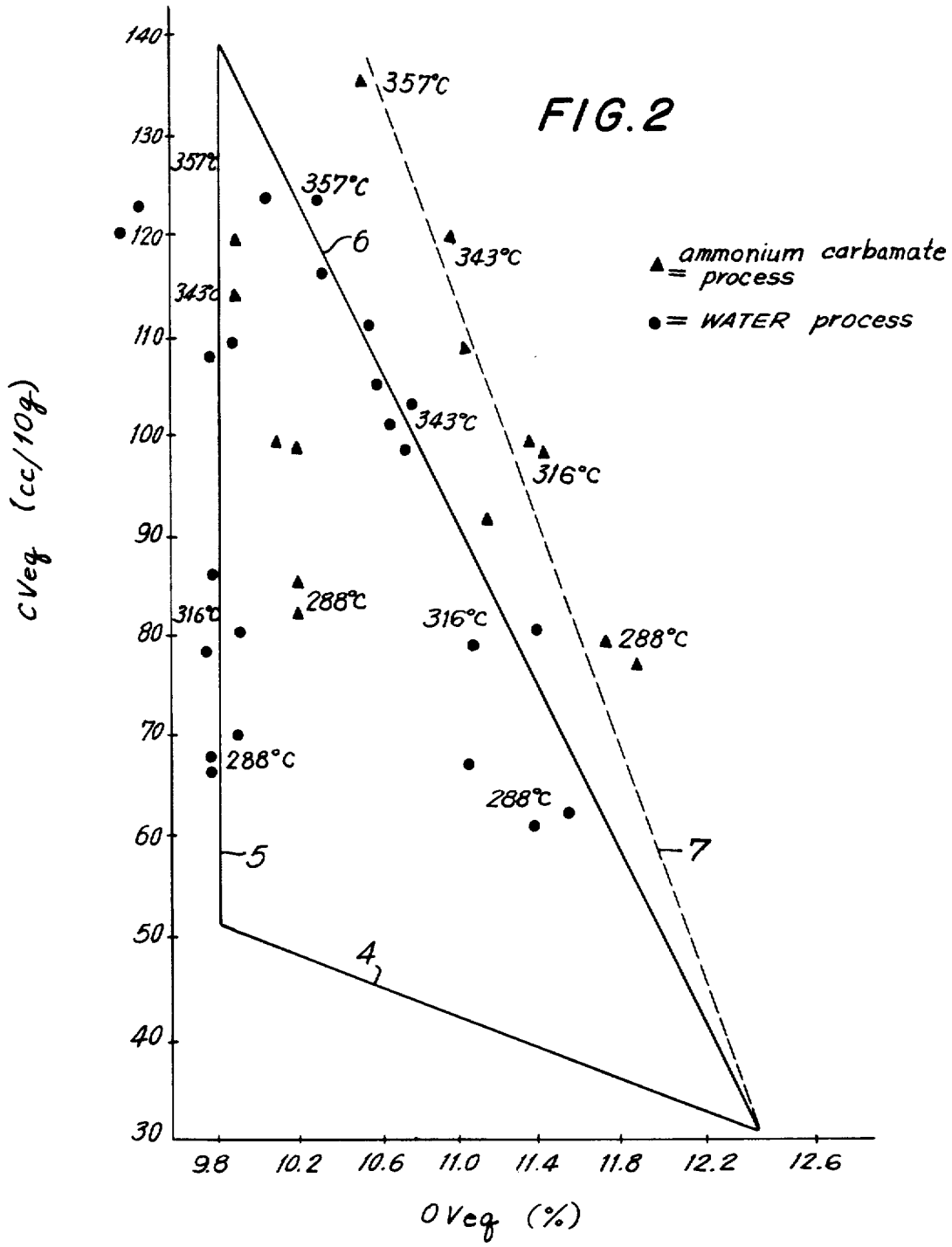
FIG. 2 is a diagram similar to FIG. 1 including a comparison of the WATER process (line 6), an expansion process employing ammonium carbamate as the impregnant (line 7) and the process of the present invention (line 4) with a subsequent expansion step which, as shown by line 5, achieves substantially the same result whether a WATER or ammonium carbamate process is employed.

As shown in FIG. 2, while the ammonium carbamate proces for the expansion of tobacco exhibits a greater increase (line 7) under equivalent treatment conditions than does a WATER process (line 6), once the tobacco has been stiffened according to the process of the present invention, there is no significant difference between the degree of expansion obtained employing a WATER process as compared to the ammonium carbamate process (line 5).

Thus, according to the present invention, unexpanded tobacco may be stiffened to increase its filling power and then, if desired, expanded according to a WATER process without the use of special equipment or impregnants which are economically disadvantageous and which, in the case of exogenous impregnants such as volatile organic liquids, can have an adverse effect on the subjective qualities of the smoke produced by the final product, which, typically, is a smoking article such as a cigarette. Alternatively, tobacco which has been expanded according to a WATER process or other expansion process may then be stiffened according to the present process.

It is essential that the moisture content of the tobacco, as measured by its OV value, be maintained substantially constant throughout the transfer of heat to the tobacco. "Substantially constant" includes minor increases or decreases in the OV value of up to about 2 OV units which may occur during treatment as a result, for instance, of leaks in a closed system when such a system is employed, or from water generated by the reactions which occur during the present process, or due to the evaporation which occurs pending the establishment of an equilibriun pressure in a closed system and which evaporative loss is substantially recovered through condensation during cooling. As will be apparent to those skilled in the art, a substantially constant moisture content is more readily obtained by employing a closed system rather than an open system. Accordingly, the present process is preferably conducted employing a closed system. Through proper control of the moisture content of the environment in which the tobacco is being treated, as by employing steam, it is contemplated that an open system could be effectively employed.

The OV value of the untreated tobacco is within the range of from about 4% to about 35%. As will be noted from curve 8 in FIG. 3, which is a plot of the CV value for the treated tobacco versus the initial or input OV of the untreated tobacco at a selected treatment temperature and time, there is a maximum increase in CV for any selected treatment temperature which corresponds to an OV value, for the untreated tobacco, within the range of from about 10% to about 16%, which, accordingly, is preferred. Particularly preferred are OV values within the range of from about 10% to about 12%. Employing tobacco in the present process which does not have an OV value that falls within the optimum range will result in a lesser increase in filling power than would have been obtained by employing the same tobacco with an OV value within the optimum range, but the full potential can be recovered by subsequently treating the tobacco at an OV value within the optimum range.

The preferred range of OV values is believed to correspond to the optimal range of water activities for the tobacco within which the reactions which are believed to result in a stiffening of the tobacco occur at their optimal rates. These reactions are believed to be one or more of the "browning reactions". From the food technology literature, it is known that the rate of the "browning reaction" passes through a maximum as a function of water activity. The rate maximum for most "browning reactions" occurs around a water activity of about 65% RH which is consistent with the preferred OV range for the present process.

The "browning reaction" is a complex process which can involve a variety of reactants. The most common type involves the reaction of aldehydes, ketones, and reducing sugars with various amino compounds such as amines, amino acids, peptides and proteins. The ultimate products of this reaction are brown polymeric compounds. The tobacco treated according to the present process typically has a distinctive brown color that is not present before treatment. Another type of "browning reaction" occurs when polyhydroxycarbonyl compounds, such as reducing sugars, are heated at relatively high temperatures in the absence of amino compounds. This process is commonly known as caramelization. A third category of "browning reaction" involves oxidative processes. Each of these reactions could, and likely does, occur during the process of the present invention.

Analysis of the tobacco treated according to the present process reveals almost total reducing sugar conversion as evidenced by the trace quantities of reducing sugars detected. The reducing sugars found in most tobaccos are believed to play significant role in the reactions which occur during the present process to stiffen the tobacco. This belief is supported by experimental results which correlate the decrease in detectable reducing sugar content for treated tobacco with increases in CV values. Experiments employing sodium bisulfite, a known "browning reaction" inhibitor, result in a decrease in filling power gain which indicates that reducing sugars are involved as do experiments run with tobacco from which all or part of the reducing sugars have been removed.

The tobacco employed in the process of the present invention is selected from the group consisting of unexpanded bright, unexpanded cased bright, expanded bright, expanded cased bright, unexpanded Burley, unexpanded cased Burley, expanded Burley, expanded cased Burley, unexpanded Oriental, unexpanded cased Oriental, expanded Oriental, expanded cased Oriental, reconstituted tobacco and mixtures thereof. Preferably the tobacco is lamina filler. As would be expected from the postulated mechanism, Burley tobacco, which contains essentially no reducing sugars, does not experience the filling power increase to the extent observed for bright and Oriental tobaccos. Accordingly, when Burley tobacco is to be treated according to the process of the invention, it is preferred that it first be contacted with one or more reducing sugars and then processed.

Figure 3:
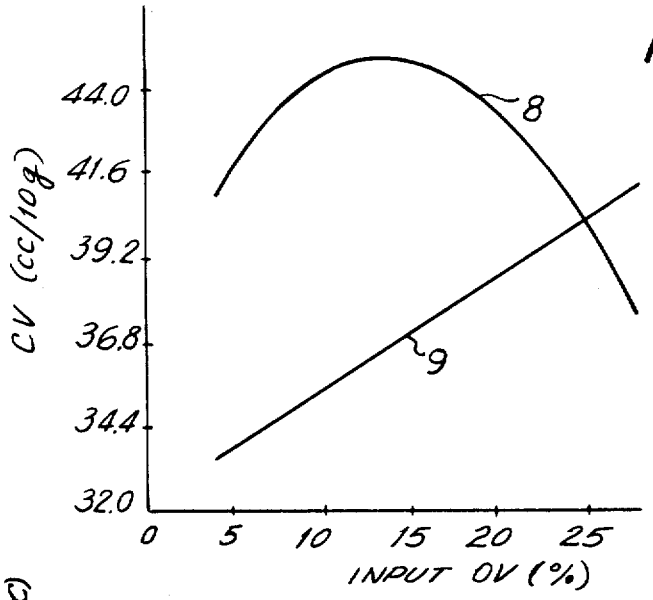
FIG. 3 is plot of post-treatment CV values versus input OV values for uncased bright tobacco samples treated according to the process of the present invention in a closed system (line 8) and, as a comparison, equivalent samples treated for the same amount of time and at the same temperature but in an open system (line 9).
Figure 4:
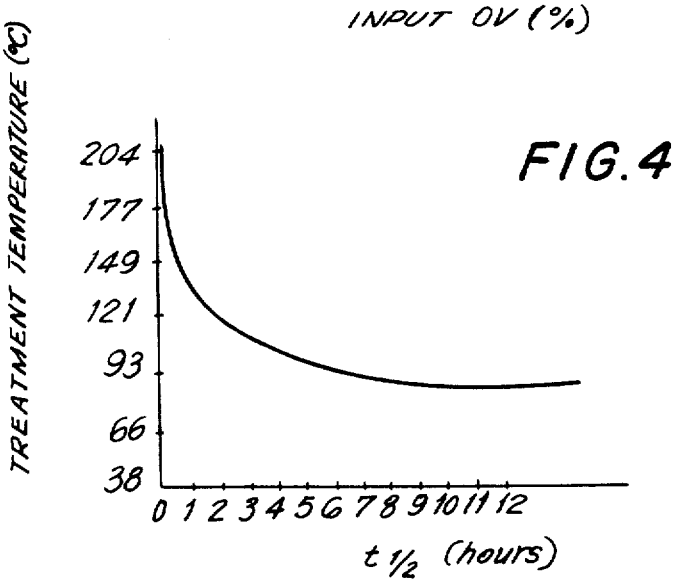
FIG. 4 is a plot of the half-time versus the treatment temperature for the present process
Figure 5:
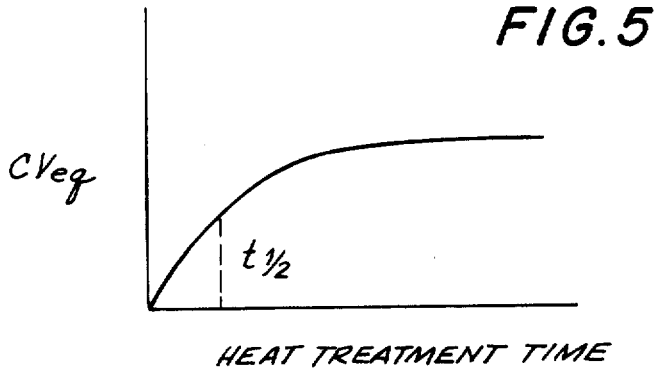
FIG. 5 is a representation of the kinetics of the present process plotted here as $CV_{eq}$ versus heating time for a selected treatment temperature.

The treatment temperature and the treatment time are interrelated as may be noted from FIGS. 4 and 5. The half time for the completion of the reactions which are believed to account for the stiffening of the tobacco during the present process decreases rapidly as the treatment temperature increases. The tobacco is heated, according to the present process, for a time sufficient to increase the CV value of the tobacco. A temperature of about 80° C., corresponding to a half time of about 12 hours, may be employed as a preferred minimum and a temperature of about 150° C., corresponding to a half time of about 2 minutes, may be employed as a preferred maximum. A particularly preferred range is from about 90° C. to about 125° C. The actual treatment time employed will depend on the temperature selected and the degree of stiffness desired. For any particular selected treatment temperature and treatment time, the increase in $CV_{eq}$ is a function of the OV value of the untreated tobacco, as is shown in FIG. 3. As shown in FIG. 5, for a selected initial OV value and treatment temperature, the desired $CV_{eq}$ value of the treated tobacco may be selected as a function of the treatment time.

Particularly preferred conditions are an OV value within the range of from about 10% to 16%, a treatment temperature within the range of from about 90° C. to about 150° C., and a treatment time within the range of from about 48 hours to about 4 minutes.

When Burley tobacco is employed in the present process, it is necessary, in order to obtain the degree of increase in filling power experienced for bright and Oriental tobaccos, to first add one or more reducing sugars to the Burley tobacco, such as by contacting, as by spraying, the tobacco with an aqueous solution of the reducing sugar. Typically, the reducing sugar is added to the Burley such that it is present at a concentration within the range of from about 3% to about 25%, by weight of the Burley, and particularly preferred is a concentration within the range of from about 5% to about 22%, by weight. Most preferably, reducing sugars are added to the Burley tobacco in an amount such that the treated Burley contains a concentration of reducing sugars substantially equivalent to the concentration of reducing sugars present in bright tobacco, that is, an amount within the range of from about 8% to about 12%.

While any of the reducing sugars typically found in tobacco may be effectively employed, it is preferred that the reducing sugar be selected from the group consisting of fructose, glucose, sucrose, 2-deoxyglucose, xylose, galactose, mannose, ribose, maltose, lactose, rhamnose, arabinose and mixtures thereof. While sucrose is not, strictly speaking, a reducing sugar, it is included because it is hydrolyzed to its component reducing sugars, glucose and fructose, under the treatment conditions of the present process. More preferably, the reducing sugar is selected from the group consisting of glucose, fructose, and mixtures thereof. Particularly preferred is glucose.

Once the Burley tobacco has been contacted with the reducing sugars, as by being sprayed with a solution of the reducing sugar, the Burley, which is at an OV value of up to about 30% to about 40%, is preferably bulked, typically for from about 24 to about 48 hours, and then is dried, preferably air dried at room temperature or mildly heated, until the solvent for the reducing sugar, typically water, has evaporated. The treated Burley is then processed as set forth above; preferably at an initial OV value within the range of from about 10% to about 16%. Although an initial reduction in $CV_{eq}$ is experienced due to the addition of the reducing sugars, the $CV_{eq}$ values obtained when the Burley is treated according to the present process are comparable to those obtained for bright tobacco when the post-treatment $CV_{eq}$ values are corrected for the weight of the added sugars.

Surprisingly, in view of the postulated mechanism by which stiffening occurs to enhance filling power, adding reducing sugars to tobacco which already contains reducing sugars does not increase the degree of stiffness obtained and thus does not result in greater increases in filling power. As the reducing sugar concentrations typically found in tobacco, such as bright tobacco, are exceeded, the degree of stiffening obtained according to the present process decreases.

The present process, as compared to the previous expansion processes, provides a more stable product in that the treated tobacco does not collapse to the extent experienced with expanded tobacc products during reordering. Additionally, while the previous processes, such as the WATER process discussed below, result in both a stiffening and an expansion of the tobacco, the degree of stiffening obtained is very difficult to control and may account for the greater degree of collapse on reordering. The degree of stiffening obtained according to the present process can be controlled. Yet another important advantage of the present process is that the discoloration and occasional charring of the tobacco, which occur during treatment according to an expansion process requiring dehydration of the tobacco, is not experienced to the same degree and thus a more commercially acceptable product can be obtained. The product of the present process possesses a pleasing aroma and flavor not found in tobacco treated according to the previous processes. The aroma and flavor are lost to a substantial degree if the treated tobacco is subsequently expanded.

While the tobacco treated according to the present process may have been previously or may be subsequently expanded, as discussed below, it is not necessary to expand the tobacco. The degree of increase in $CV_{eq}$ obtained by employing only the present process is commercially significant and results in a product which may be included in smoking articles, such as cigarettes, without first being combined with untreated tobaccos, that is, tobaccos which have not been subjected to the present process or a known expansion process.

Any apparatus capable of transferring heat to the tobacco for the treatment times of the present invention without any substantial change in the OV value of the tobacco may be employed. By way of example and not limitation, the present process has been conducted on a lab scale by placing the tobacco in a cylinder which is welded closed at one end and fitted with a close-fitting cover which is clamped on the open end. The cylinder is placed in an oven at a pre-selected temperature for the time required for the reactions of the reducing sugar to proceed substantially to completion. On a pilot plant scale, the present process has been effectively employed using an autoclave which is heated by passing steam through its jacket in order to maintain a pre-selected temperature. On a commercial scale, it is contemplated that considerably larger apparatus will be constructed along the lines of the apparatus employed on the lab scale and the pilot plant scale. Preferably, the apparatus contains means for maintaining a substantially constant and uniform rate of heat transfer to the tobacco during treatment in order to produce a more uniformly treated tobacco.

The present invention is not intended to be limited by the particular apparatus employed and thus any apparatus currently existing which is capable of maintaining the process parameters of the present invention or which can be so modified may be employed, as may any device which would occur to those skilled in the art as capable of maintaining the process parameters of this invention. For example, a conventional pressure vessel, such as an auto-clave, may be effectively employed.

Surprisingly, in view of the amount of stiffening obtained, treated unexpanded tobacco, which might be considered by those skilled in the art to have lost its capacity to expand, may yet be further treated according to an expansion process thereby further increasing its filling power. One disadvantage of further treating the tobacco to expand it is that the alkaloid content of the tobacco, which remains substantially constant throughout the process of the present invention, is substantially decreased during the expansion treatment to a level that it is only marginally higher than is obtained employing just the expansion process. Another disadvantage is that the pleasing aroma and flavor obtained according to the present process are substantially lost during a subsequent expansion step.

When the tobacco is lamina filler, it may, if desired, first be treated according to a known expansion process and then treated according to the present process, or the treated filler of the present process may then be expanded according to a known expansion process, to further increase its filling power. Suitable expansion processes include those employing, as the impregnant, ammonia and carbon dioxide or ammonium carbonate, ammonium carbamate, or the like, such as are disclosed in U.S. Pat. No. 3,771,533 and U.S. Pat. No. 4,266,562. Also suitable are the aforementioned WATER processes and those processes employing carbon dioxide as the impregnant, such as are disclosed in U.S. Pat. No. 4,235,250, U.S. Pat. No. 4,258,729, U.S. Pat. No. 4,336,814, and commonly assigned U.S. patent application Ser. No. 441,767, filed Feb. 12, 1974. Since the result achieved in expanding the treated filler of the present invention is substantially the same whether one of the WATER processes or a process employing $CO_2$ or the like is employed, it is preferred to employ one of the more economical WATER processes. If the tobacco is to be expanded prior to its treatment according to the present process, any of the aforementioned processes may also be employed but it is still preferred to employ on of the more economical WATER processes.

A Preferred WATER Process

According to a preferred WATER process, the filler is contacted with a heat transfer medium such that heat is rapidly and substantially uniformly transferred from the medium to the filler for a total contact time sufficient to expand the filler. It has been discovered that the combination of rapid and substantially uniform heat transfer with the relatively low initial moisture content of the filler results in an expansion of the filler which produces significant increases in filling power even when the filler has first been treated according to the present process. It has been observed that the rate of heat transfer must be rapid in order to achieve the expansion, or geometric change.

In order to obtain a constant and optimal result with the WATER process, it is important that the heat be substantially uniformly transferred to the filler. Thus, the filler must be contacted with the heat transfer medium in such a way as to provide a substantially uniform contact between the shreds and the heat transfer medium. If such steps are not taken to insure substantially uniform heat transfer, the twice-treated filler will not have achieved its full potential increase in filling power.

The rate of heat transfer in the WATER process is generally independent of the type of apparatus employed and though a means has not been devised by which the rate may be directly measured, the optimum rate of heat transfer may be established experimentally by adjusting the various operating parameters of the apparatus employed such that the filler has an OV value, immediately after being contacted with the heat transfer medium, of less than about 7%, preferably less than about 5% and more preferably less than about 3%. It is particularly preferred that the OV value be within the range of from about 0.5% to about 4% immediately after being contacted with the heat transfer medium. A preferred minimum OV value is about 0.5%.

The post-treatment OV value of the filler is not, in and of itself, a oritioal parameter since the OV value of the filler may be gradually decreased to within that range over a period of hours, days, or even months without expansion of the filler. But, provided that an apparatus has been selected in which the filler may be substantially uniformly contacted with the heat transfer medium and provided that a heat transfer medium has been selected that permits a rapid transfer of heat to the filler, then, by adjusting the heat content of the heat transfer medium and the total contact time of the filler with the medium, the post-treatment OV value will be within the aforementioned range when the parameters have been properly selected to provide a rapid and substantially uniform transfer of heat from the medium to the filler.

The total contact time during the WATER process will be short enough that the total heat transferred to the filler is less than the amount which will result in burning or otherwise discoloring the filler and yet long enough to provide sufficient transfer of heat from the heat transfer medium to the filler to allow the stiffening reactions to proceed essentially to completion at the selected water activity value and to allow expansion to occur. The total contact time is also preferably as short as possible in order to minimize the loss of alkaloids which, unlike the process of the present invention, are increasingly lost with increasing tobacco temperature. As the rate of heat transfer or the heat content of the medium increases, the contact time will decrease.

Generally, this total contact time will be less than about 4 seconds and may be as low as 0.1 second. Total contact times of up to about 10 seconds have been employed but particularly good results have been observed when employing total contact times within the range of from 0.1 second to about 6 seconds and more particularly within the range of from 0.1 second to about 4 seconds. A preferred minimum contact time is about 1 second.

When fillers are employed in the WATER process that have a high water activity value, corresponding to OV values in excess of 20% and more particularly in excess of 30%, the total heat which must be transferred to the filler is greatly increased since a large portion of the transferred heat is required to evaporate the excess water. Accordingly, it is preferred to use filler having an OV value within the range of about 8% to about 14% which corresponds to the optimal OV values for the present process and thus filler treated according to the present process may be expanded without first being re-equilibrated.

The heat transfer medium in the WATER process is a solid or a gas which has a sufficiently high specific heat to allow rapid transfer of its heat content to the filler when it is contacted therewith. The heat transfer medium may also be a beam of energy such as a beam of radiant energy. One preferred heat transfer medium is a high velocity gas at elevated temperature, such as a gas comprising at least about 50% steam, preferably at least about 80% steam, and having a temperature of at least about 232° C. The rate of heat transfer from such a gas will vary depending on the percent steam content, the gas velocity, and the temperature, all of which are interrelated. Preferably, the treated filler is contacted with the gas by being substantially uniformly dispersed therein. Another preferred heat transfer medium is radiant energy such as infrared energy, and preferably, the treated filler is contacted with the radiant energy by being substantially uniformly exposed thereto.

The WATER process may be conducted employing any apparatus which may be adjusted or adapted to rapidly and substantially uniformly transfer heat from the heat transfer medium to the filler and which allows the total contact time to be controlled. One suitable apparatus is a dispersion dryer, which is generally known in the art as a "tower". Another apparatus which may be employed is a image furnace which is essentially a parabolic mirror wherein radiant energy is focused at one focal point and the filler is substantially uniformly contacted with the reflected and focused radiant energy by being transported past the second focal point for a total contact time sufficient to expand the filler.

When the WATER process is practiced employing a tower, the various parameters, such as the tobacco feed rate, must be adjusted and/or the tower must be adapted to provide for a substantially uniform transfer of heat from the heat transfer medium to the treated filler at the optimum rate of heat transfer. When operating a relatively small tower, such as an 8 cm or 20 cm diameter tower, substantially uniform transfer of the heat from the gaseous medium to the treated filler may be realized by adjusting the tobacco feed rate so that the tobacco is substantially uniformly dispersed in the gaseous medium and the optimum heat transfer rate may be established by adjusting the temperature, velocity, and steam content of the gaseous medium to provide a rapid and optimum rate of heat transfer at the selected moisture content, or water activity, of the filler.

By way of example, with an 8 cm or a 20 cm diameter tower, to establish an optimum rate of heat transfer and a substantially uniform heat transfer, the gaseous medium will comprise at least about 50% dry steam, with higher volumes of dry steam being preferred; the velocity of the gaseous medium will be at least about 12 m/sec. and preferably about 30 m/sec. to about 52 m/sec.; and the temperature of the gaseous medium will be at least about 230° C., preferably within the range of from about 230° C. to about 400° C. and, more preferably, within the range of from about 290° C. to about 360° C. Total contact times will generally be within the range of from about 1 second to about 6 seconds, preferably from about 1 second to about 4 seconds, and the tobacco feed rate will preferably be within the range of from about 181 g/min. to about 1360 g/min.

It is to be understood that the steam content, temperature, and velocity are selected to provide the optimum rate of heat transfer for the selected heat transfer medium and tower and that the tobacco feed rate is selected for the particular tower to provide substantially uniform contact of the filler with the heat transfer medium. With the 8 cm and 20 cm towers, when the various parameters are selected to provide for contact of the treated filler with the heat transfer medium such that heat is rapidly and substantially uniformly transferred from the medium to the filler, the OV value of the filler immediately after treatment will generally be within the range of from about 0.5% to about 5%. If the process is scaled up to commercial operation employing larger towers, such as 60 cm towers, the various parameters must be adjusted and, in some instances, it is contemplated that the structure of the tower will have to be adapted to provide for the optimum rate of heat transfer.

The optimum rate of heat transfer is essentially independent of the type of apparatus employed, and thus the various adjustments and adaptations which are made will be to establish this optimal rate in the apparatus selected. Additionally, the water activity ranges are essentially independent of the type of apparatus employed.

The expanded filler is much drier than desired for further processing or use. Therefore, to avoid breakage and to insure satisfactory smoking qualities, it is preferred that the filler be reordered (rehumidified) to a moisture level in equilibrium with normal use conditions before it is handled and processed. Typically, the expanded filler will be reordered to an OV value within the range of from about 8% to about 13%.

The product obtained according to the WATER process, whether initially or subsequently treated according to the present process, may be used to manufacture smoking articles, such as cigarettes, in the conventional manner, or it may be mixed with other tobaccos to provide a desirable blend for use in the manufacture of such smoking articles. The expanded and stiffened filler is particularly suited to being incorporated in cigarettes since no materials foreign to the tobacco are used in either the WATER process or the present process and thus no residual foreign material is left in the treated filler to affect taste during smoking.

According to the present process, a stiffened, unexpanded filler may be produced having a pre-selected $CV_{eq}$ value for incorporation directly into smoking articles, such as cigarettes or the like. Advantageously, this product does not contain any residue from foreign materials added as impregnants which can adversely affect the flavor of the smoke and has a pleasing aroma and flavor and a virtually undiminished alkaloid content.

EXAMPLES

The following examples present illustrative but nonlimiting embodiments of the present invention. Comparative examples are also presented.

Some of the examples represent experiments which were conducted on a lab scale employing, as the apparatus, 30.5 cm lengths of 5 cm OD stainless steel pipe (hereinafter "a cylinder") welded shut at one end and equipped at the other end with a cap adapted to be clamped securely onto the open end of the pipe. The cap was equipped with a thermocouple for use in measuring the temperature of the tobacco within the cylinder, and a burst diaphragm (approximately 1550 torr (gauge) maximum).

In use, a sample of tobacco was placed in a cylinder, the cap clamped securely on the open end and the sample was then placed in an oven which had been heated to the desired temperature. The system was essentially a closed one and thus the moisture in the tobacco and the moisture produced by the thermally induced reactions was not lost. Accordingly, employing this system, the tobacco may be heat treated at a substantially constant OV value and, as evidenced by the examples below, a substantially constant SV value.

The cylinder was capable of holding about 90 grams of tobacco. A thermocouple was also placed in the oven so that the outside temperature could be measured. It was determined by comparing the thermocouple readings that a sample at room temperature placed in a preheated oven required about 90 minutes to achieve 99% of thermal equilibrium.

Other examples represent experiments which were carried out on a pilot plant scale employing, as the apparatus, an autoclave which was a 45.7 cm diameter stainless steel cylinder 68.6 cm in length and jacketed for a heating medium. The autoclave was provided with thermocouples to monitor temperature at various points within the tobacco bed and the internal headspace. The output from the thermocouples was fed to a recorder. The autoclave was also equipped with a pressure relief valve (1700 torr (gauge) maximum) and pressure gauges for both the internal and the jacketed sections. The autoclave had a $1.1\times10^{-1}m^3$ capacity and was capable of holding about 9 Kg of tobacco.

In use, heating was accomplished by circulating up to 5170 torr (gauge) steam through the jacket. The tobacco was placed in mesh basket containers (35.6 cm diameter and 6 cm length) fabricated to allow treatment of 9 Kg of tobacco per batch and equipped with legs to keep the tobacco from coming in contact with the jacketed walls. A fairly uniform temperature profile was maintained within the sample and it was determined that a sample starting at room temperature required about 4 hours to reach thermal equilibrium.

EXAMPLE 1

Samples of different tobaccos were treated in the cylinder at 93° C. for 48 hours and for each tobacco sample a comparative example was run by heating an equivalent sample in an open pan in the same oven at 93° C. for 48 hours. The input OV values for the samples, with the exception of the reconstituted tobacco (hereinafter "recon."), were within the range of from 12% to 14%. The recon. samples were heated at 135° C. for 48 hours and the input OV was 30%. The moisture content of the samples treated in the cylinder remained substantially constant during treatment whereat the samples treated in the open pan lost considerable moisture as evidenced by a drop in OV values to about 1% during the course of the treatment. After treatmnet, the samples were equilibrated and the $OV_{eq}$ and $CV_{eq}$ values measured. The results are summarized below in Table I.

TABLE I

| | OPEN PAN | | | | CYLINDER | |
|---|---|---|---|---|---|---|
| | CONTROL | | (Comparative) | | | |
| SAMPLE | $CV_{eq}$ (cc/10 g) | $OV_{eq}$ (%) | $CV_{eq}$ (cc/10 g) | $OV_{eq}$ (%) | $CV_{eq}$ (cc/10 g) | $OV_{eq}$ (%) |
| Commercial blend (bright, Burley, Oriental, recon. and expanded stems) | 36.2 | 13.35 | 44.5 | 10.79 | 48.2 | 10.88 |
| bright (uncased) | 29.7 | 11.80 | 35.9 | 10.40 | 44.1 | 9.86 |
| Expanded bright (uncased) | 98.8 | 10.10 | 108.8 | 9.63 | 113.8 | 8.87 |
| Burley (uncased) | 35.7 | 11.37 | 35.9 | 10.34 | 39.5 | 10.52 |
| recon. | 37.0 | 12.63 | 51.6 | 10.23 | 51.4 | 9.29 |

Input and exit OV values for three of the cylinder treated samples are presented in Table II and indicate that there was a slight increase in the OV value during treatment.

TABLE II

| | CYLINDER | |
|---|---|---|
| Sample | Input OV, (%) | Exit OV, (%) |
| Commercial Blend (bright, Burley, Oriental recon. and expanded stems) | 12.01 | 13.10 |
| bright (uncased) | 12.67 | 14.41 |
| Burley | 14.02 | 14.47 |

EXAMPLE 2

Identical samples of bright tobacco having different initial OV values were treated in the cylinder at 93° C. for 48 hours without decreased in the OV value and then equilibrated before measuring the $CV_{eq}$ and $OV_{eq}$ values. The results are presented below in Table III. The control represents untreated tobacco which was re-equilibrated before measuring the CV and OV values.

TABLE III

| | Control | | Cylinder | |
|---|---|---|---|---|
| Input OV (%) | $CV_{eq}$ (cc/10 g) | $OV_{eq}$ (%) | $CV_{eq}$ (cc/10 g) | $OV_{eq}$ (%) |
| 4.12 | 31.7 | 11.95 | 49.6 | 9.19 |
| 4.81 | 35.5 | 11.76 | 48.7 | 9.12 |
| 9.91 | 34.1 | 11.97 | 54.5 | 9.60 |
| 13.71 | 33.7 | 12.06 | 51.2 | 9.91 |
| 16.93 | 33.9 | 12.92 | 50.9 | 10.01 |
| 20.25 | 34.1 | 12.38 | 46.1 | 10.24 |
| 23.41 | 35.5 | 12.38 | 46.9 | 10.51 |

EXAMPLE 3

It is believed that the increased filling power obtained according to the constant moisture process of the present invention is due to a stiffening of the tobacco which results from the reaction of reducing sugars in a "browning reaction." In support of this hypothesis, the following experiment was conducted in which five samples (A through E) of bright tobacco and one sample of Burley tobacco (F), which contains essentially no reducing sugars, were each treated according to the process of the invention in a cylinder at 93° C. for 48 hours. Sample E was extracted with ethanol to decrease its reducing sugar content. After treatment, the samples were re-equilibrated along with untreated portions of each sample, as controls, and then the $CV_{eq}$ and $OV_{eq}$ values determined. The change in the $CV_{eq}$ value from the control to the treated portion was calculated and the results are presented below in Table IV.

TABLE IV

| Sample | Initial Concentration of Reducing Sugars, (%) | Control $CV_{eq}$ (cc/10 g) | Control $OV_{eq}$ (%) | Cylinder $CV_{eq}$ (cc/10 g) | Cylinder $OV_{eq}$ (%) | $\Delta CV_{eq}$ (cc/10 g) |
|---|---|---|---|---|---|---|
| A | 13.3 | 30.4 | 12.13 | 47.9 | 9.77 | 17.5 |
| B | 11.4 | 29.9 | 11.32 | 45.4 | 9.60 | 15.5 |
| C | 8.2 | 33.9 | 11.64 | 47.0 | 9.80 | 13.1 |
| D | 3.7 | 35.9 | 11.10 | 44.3 | 9.93 | 8.4 |
| E | 2.9 | 57.1 | 11.14 | 65.3 | 7.69 | 8.2 |
| F | 0 | 36.4 | 10.72 | 40.1 | 10.12 | 3.7 |

Analysis after treatment revealed that the reducing sugar concentrations had been reduced to less than 2%. The data indicates a strong correlation between reducing sugar concentration and CV increase. A linear relationship was obtained using a least squares analysis of the data in Table V, excluding the results for Burley and for Sample E which had been extracted with ethanol to achieve the 2.9% concentration of reducing sugars. This analysis resulted in the following equation:

$$\Delta CV = 5.1 + 0.93\ (RS)$$

wherein RS is the reducing sugar concentration, in percent. The points for Samples E and F do fall on this line. The results and analysis demonstrate that a significant portion of the CV increase for bright tobacco treated according to the present process is attributable to reactions of reducing sugars in a "browning reaction."

EXAMPLE 4

In view of the result obtained in Example 3, an experiment was conducted to determine whether adding sugar to tobacco and then treating it according to the process of the invention would result in a greater increase in the $CV_{eq}$ of the treated tobacco. Accordingly, samples of bright tobacco were sprayed with equimolar amounts (0.17 mole per 300 grams of bright tobacco) of glucose, 2-deoxyglucose, and xylose, raising the reducing sugar concentration of the tobacco to about twice its original value of 10%. As comparative examples, an additional sample of bright tobacco was sprayed only with water and yet another sample was left untreated. As controls, portions of each sample were not treated but rather were re-equilibrated and their CV and OV values determined. The remaining portions of each sample were treated according to the process of the invention in the cylinder at 93° C. for 48 hours and then re-equilibrated, their $CV_{eq}$ and $OV_{eq}$ values determined and, for the sugar-sprayed samples, the $CV_{eq}$ and $OV_{eq}$ values were oorreoted to take into account the weight of the sugar added to the samples. The results are presented below in Table V.

TABLE V

| Sample | Control $CV_{eq}$ (cc/10 g) | Control $OV_{eq}$ (%) | Cylinder $CV_{eq}$ (cc/10 g) | Cylinder $OV_{eq}$ (%) | $\Delta CV_{eq}$ (cc/10 g) |
|---|---|---|---|---|---|
| Untreated (Comparative) | 32.8 | 12.22 | 54.5 | 9.61 | 21.7 |
| Water (Comparative) | 36.1 | 12.37 | 56.5 | 9.66 | 20.4 |
| Glucose | 31.2 | 13.50 | 57.7 | 9.90 | 26.5 |
| 2-Deoxyglucose | 32.7 | 13.65 | 60.2 | 9.71 | 27.5 |
| Xylose | 29.8 | 14.33 | 55.7 | 9.62 | 25.9 |

The $\Delta ACV_{eq}$ values indicate that spraying bright tobacco with sugar before treatment does not significantly increase the filling power as compared to the controls, whereas merely spraying bright tobacco with water increases the $CV_{eq}$ value by about 10%. As compared to the untreated control, spraying the bright tobacco with a sugar solution actually reduces the $CV_{eq}$ value of the samples, as compared to the untreated control. Once these samples were treated according to the process of the invention, the resulting $CV_{eq}$ values, as presented in Table VI, were essentially equivalent. The data also indicate that there are no significant differences in terms of increased filling power attributable to the type of sugar applied to the bright tobacco.

EXAMPLE 5

Since Burley tobacco contains essentially no reducing sugars, an experiment was conducted to determine whether adding reducing sugars to Burley tobacco and then treating the resulting tobacco according to the process of the invention would produce a result which approximates that obtained with bright tobacco. Accordingly, samples of Burley tobacco were sprayed with an aqueous solution of glucose, fructose, sucrose and a one to one mixture of glucose and fructose so that the treated tobacco contained 10% of the sugar, by weight. As comparative examples, one sample was not treated and another sample was sprayed with an equal amount of water containing no sugar. The samples were bulked, air dried to an OV value of about 12%, and then treated according to the process of the invention in a cylinder at 93° C. for 48 hours. The treated samples were re-equilibrated and the $CV_{eq}$ and $OV_{eq}$ values determined, which, for the sugar treated samples, were then corrected to take into account the weight of the sugar applied. The corrected values were obtained by multiplying the $CV_{eq}$ equilibrium values by 1.1 thereby accounting for the weight of the sugar which was added to the tobacco at 10%, by weight. Portions of each sample were not treated but were re-equilibrated and the $CV_{eq}$ and $OV_{eq}$ values determined. The results are presented below in Table VI.

TABLE VI

| Sample | Control $CV_{eq}$ (cc/10 g) | Control $OV_{eq}$ (%) | Cylinder $CV_{eq}$ (cc/10 g) | Cylinder $OV_{eq}$ (%) | $\Delta CV_{eq}$ (cc/10 g) |
|---|---|---|---|---|---|
| Untreated (Comparative) | 42.8 | 11.27 | — | — | — |
| Water (Comparative) | 55.6 | 11.41 | 60.5 | 10.26 | 4.9 |
| Fructose | 44.7 | 12.55 | 57.8 | 10.28 | 13.1 |
| Glucose | 45.6 | 12.47 | 61.6 | 10.06 | 16.0 |
| Fructose + Glucose | 46.1 | 12.61 | 59.4 | 10.32 | 13.3 |
| Sucrose | 46.7 | 12.35 | 59.6 | 10.15 | 12.9 |
| AFTER CORRECTING FOR THE WEIGHT OF THE SUGAR APPLIED | | | | | |
| Fructose | 49.2 | 12.55 | 63.6 | 10.28 | 14.4 |

TABLE VI-continued

| Sample | Control $CV_{eq}$ (cc/10 g) | Control $OV_{eq}$ (%) | Cylinder $CV_{eq}$ (cc/10 g) | Cylinder $OV_{eq}$ (%) | $\Delta CV_{eq}$ (cc/10 g) |
|---|---|---|---|---|---|
| Glucose | 50.2 | 12.47 | 67.8 | 10.06 | 17.6 |
| Fructose + Glucose | 50.7 | 12.61 | 65.32 | 10.32 | 14.6 |
| Sucrose | 51.4 | 12.35 | 65.6 | 10.15 | 14.2 |

The corrected CV values indicate that the added sugar does increase the CV gain compared to the water sprayed control and indicates further that glucose may be more effective than the other sugars in increasing the gain in filling power of Burley when treated according to the present process.

EXAMPLE 6

Samples of a blend of bright tobaccos, an uncased unexpanded bright tobacco and an uncased bright tobacco that had been subjected to an expansion process were treated according to the present process in cylinders in an oven at 93° C. for 48 hours and, as comparative examples, indentical samples were heated in open aluminum pans in the same oven at the same time. The cylinder treated samples were moist whereas the open pan treated samples were bone dry. As controls, a sample of each tobacco was not subjected to heat treatment. All samples were equilibrated and their $CV_{eq}$ and $OV_{eq}$ values determined. The results are summarized below in Table VII.

TABLE VII

| Sample | Input OV (%) | Control $CV_{eq}$ (cc/10 g) | Control $OV_{eq}$ (%) | Open Pan (Comparative) $CV_{eq}$ (cc/10 g) | Open Pan (Comparative) $OV_{eq}$ (%) | Cylinder $CV_{eq}$ (cc/10 g) | Cylinder $OV_{eq}$ (%) |
|---|---|---|---|---|---|---|---|
| Blend | 12.16 | 36.2 | 13.35 | 44.5 | 10.79 | 48.2 | 10.88 |
| Unexpanded | 9.64 | 38.4 | 10.67 | 42.2 | 9.97 | 48.1 | 9.40 |
| Expanded | 8.47 | 98.8 | 10.10 | 108.8 | 9.63 | 113.8 | 8.87 |

EXAMPLE 7

To determine what effect the present process has on the subjective characteristics of the treated tobacco, 120 cigarettes were manufactured containing, as the tobacco, only uncased, unflavored and unexpanded bright tobacco. These cigarettes were divided into three portions one of which was retained as a control, a second of which was treated according to the present process at 93° C. for 6 hours and the third treated according to the present proces at 93° C. for 24 hours. All of these portions were then submitted to an experienced screening panel for subjective analysis of aroma and flavor. The cigarettes were identified as control, 6 hours, and 24 hours models. The results of this screening are as follows.

(1) The tobaccos of the treated cigarette samples were darker in appearance than the control tobacco.

(2) The fragrant green haylike aroma of flue cured tobacco was present in the control but not obvious with the treated cigarettes.

(3) The 6 hours sample exhibited a toasted aroma similar to that of freshly expanded tobacco while the 24 hours sample had a more toasted, caramelized aroma.

(4) The smoke flavor of the treated cigarettes was judged to be somewhat different from the control; however, no obvious off notes were observed.

(5) The 6 hours sample, compared with the control, was judged to be only slightly different overall.

(6) The 6 hours sample was somewhat thinner, harsher and lower in bright character.

(7) The 24 hours sample was found to be lower in Bright character, somewhat hotter, thinner with more throat harshness. A sweet slightly floral note was also observed with this sample, which was judged to be slight to modestly different from the control.

(8) The 6 hours sample when smoked against the 24 hours sample was described as more bright-like, slightly hotter initially, but softer at the end and more aromatic. The 24 hours sample was judged slightly sweeter with a heavier, more bitter flavor note.

(9) Both of the treated samples retained flue cured characteristics.

EXAMPLE 8

4.54 Kg samples of bright tobacco having an initial OV value of 13.2% were treated, according to the present process, at 7 different treatment times and 2 different treatment temperatures. The post-treatment OV values were determined and then these samples were re-equilibrated and the $OV_{eq}$ and $CV_{eq}$ values determined. The results are summarized below in Tables VIII and IX.

TABLE VIII

| TREATMENT TIME (HRS) | Post-Treatment OV (%) (93° C.) | Post-Treatment OV (%) (110° C.) |
|---|---|---|
| 0 | 13.2 | 13.2 |
| 2 | — | 11.6 |
| 4 | — | 10.1 |
| 6 | 11.3 | 11.7 |
| 12 | 9.0 | 12.1 |
| 24 | 9.9 | 7.8 |
| 48 | 9.2 | 6.9 |

TABLE IX

| TREATMENT TIME (HRS) | AT 93° C. $CV_{eq}$ (cc/10 g) | AT 93° C. $OV_{eq}$ (%) | AT 110° C. $CV_{eq}$ (cc/10 g) | AT 110° C. $OV_{eq}$ (%) |
|---|---|---|---|---|
| 0 | 35.7 | 11.9 | 35.7 | 11.9 |
| 2 | — | — | 39.1 | 10.0 |
| 4 | — | — | 41.1 | 10.6 |
| 6 | 39.9 | 10.6 | 44.3 | 10.7 |
| 12 | 45.0 | 10.2 | 45.8 | 10.0 |
| 24 | 43.4 | 9.6 | 52.3 | 8.4 |
| 48 | 46.8 | 9.1 | 41.6 | 8.4 |

EXAMPLE 9

Example 8 was repeated using bright tobacco from different lots at a temperature of 110° C. The treated tobacco was subjected to chemical analysis to determine the total alkaloids content (NIC), the total reducing sugars content (TRS) and the total hot water solubles content (HWS). The chemical analysis values were calculated on a dry weight basis. The results are presented below in Table X and Table XI.

TABLE X

| TREATMENT TIME (HRS) | EXIT OV (%) | $CV_{eq}$ (cc/10 g) | $OV_{eq}$ (%) | CHEMICALS NIC (%) | TRS (%) | HWS (%) |
|---|---|---|---|---|---|---|
| 0 | 10.7 | 33.4 | 12.3 | 2.8 | 7.9 | 57 |
| 2 | 10.8 | 34.1 | 12.6 | 2.8 | 8.2 | 58 |
| 4 | 9.0 | 34.3 | 12.4 | 2.8 | 7.2 | 58 |
| 6 | 7.0 | 43.4 | 10.2 | 2.6 | 4.2 | 57 |
| 12 | 7.1 | 47.9 | 10.1 | 2.6 | 1.9 | 53 |
| 24 | 9.8 | 50.7 | 10.0 | 2.5 | 1.9 | 48 |

TABLE XI

| TREATMENT TIME (HRS) | EXIT OV (%) | $CV_{eq}$ (cc/10 g) | $OV_{eq}$ (%) | CHEMICALS NIC (%) | TRS (%) | HWS (%) |
|---|---|---|---|---|---|---|
| 0 | 11.8 | 33.9 | 12.0 | 2.8 | 7.8 | 57 |
| 2 | 10.8 | 43.8 | 10.0 | 3.0 | 6.7 | 57 |
| 4 | 10.1 | 41.7 | 10.4 | 2.6 | 6.5 | 58 |
| 48 | 4.7 | 44.5 | 9.3 | 2.6 | TRACE | 47 |

EXAMPLE 10

Example 9 was repeated at 93° C. and 110° C. and only the NIC, TRS and HWS values were determined. These values were calculated on a dry weight basis. The results are presented below in Table XII.

TABLE XII

| TREATMENT TIME (HRS) | AT 93° C. NIC (%) | TRS (%) | HWS (%) | AT 110° C. NIC (%) | TRS (%) | HWS (%) |
|---|---|---|---|---|---|---|
| 0 | 2.8 | 6.9 | 58 | 2.8 | 6.9 | 58 |
| 2 | — | — | — | 2.7 | 5.8 | 56 |
| 4 | — | — | — | 2.8 | 6.1 | 55 |
| 6 | 2.7 | 5.4 | 58 | 2.8 | 3.3 | 55 |
| 12 | 2.7 | 3.3 | 54 | 2.7 | 2.0 | 54 |
| 24 | 2.6 | 2.9 | 53 | 2.6 | TRACE | 45 |
| 48 | 2.6 | TRACE | 46 | 2.5 | TRACE | 45 |

EXAMPLE 11

Samples of bright filler were treated according to the process of the invention for different treatment times at 93° C. and then subjected to heat treatment in an 8 cm tower, equipped with a cyclone separator, at a temperature of 302° C., a feed rate of 150 grams per minute, and a gas velocity of 39.6 meters per second. The gas employed comprised 100% steam, by volume. With the exception of one sample of the cylinder treated tobacco which was first impregnated with liquid $CO_2$, the cylinder treated tobacco was expanded employing a WATER process. As a control, untreated bright filler was re-equilibrated and the various values determined as set forth below. As comparative examples, two portions of bright filler, which had not been cylinder treated, were treated according to the WATER process or according to a $CO_2$ expansion process. For the control and each tower-treated sample, the Exit OV, $CV_{eq}$ and $OV_{eq}$ values were determined and each sample was subjected to chemical analysis to determine the NIC, TRS, and HWS values, as calculated on a dry weight basis. The results are summarized below in Table XIII.

TABLE XIII

| TREATMENT TIME (HRS) | TOWER EXIT OV (%) | $CV_{eq}$ (cc/10 g) | $OV_{eq}$ (%) | CHEMICALS NIC (%) | TRS (%) | HWS (%) |
|---|---|---|---|---|---|---|
| 0[1] | — | 35.7 | 11.9 | 2.8 | 6.9 | 58 |
| 0[2] | 1.9 | 77.5 | 10.4 | 1.8 | 5.9 | 55 |
| 0[3] | 2.8 | 58.0 | 10.4 | 1.9 | 5.6 | 54 |
| 2 | 2.1 | 58.7 | 10.2 | 2.1 | 4.4 | 55 |
| 4 | 1.9 | 63.3 | 9.8 | 1.9 | 3.8 | 54 |
| 6 | 1.6 | 59.3 | 9.5 | 2.1 | 2.8 | 53 |
| 12 | 1.5 | 59.8 | 9.3 | 2.1 | 1.8 | 49 |
| 24 | 0.9 | 60.4 | 8.8 | 2.1 | TRACE | 46 |
| 48 | 0.7 | 54.4 | 8.6 | 2.0 | TRACE | 45 |
| 48[4] | 1.0 | 71.3 | 8.9 | 1.9 | TRACE | 46 |

[1]Unimpregnated bright filler; not cylinder treated; not expanded. (control).
[2]$CO_2$ impregnated; not cylinder treated. (comparative).
[3]Impregnated only with water; not cylinder treated. (comparative).
[4]Cylinder treated and impregnated with $CO_2$.

EXAMPLE 12

Cut bright filler, equilibrated to 12% OV, was treated according to the process of the present invention at 93° C. for 48 hours. The samples were allowed to cool to room temperature (CV=51.6/10 g; OV=9.8%) and re-equilibrated (12% $OV_{eq}$).

The treated tobacco samples were then subjected to a WATER process. As a comparative example, samples of untreated cut bright filler having an initial $CV_{eq}$ value of 31.0 cc/10 g and an $OV_{eq}$ value of 12.4% were also expanded using the same WATER process. The samples were bulked for about 18 hours at room temperature before expansion.

Portions of each sample were treated according to the WATER process at 4 different temperatures (288° C., 316° C., 343° C. and 357° C.) in an 8 cm tower, equipped with a cyclone separator, at a tobacco feed rate of 150 grams per minute and a gas velocity of 39.6 meters per second. The gas contained 100% steam, by volume. The treated samples were then analyzed for total reducing sugars, total alkaloids, chlorogenic acid and rutin and the $SV_{eq}$, $CV_{eq}$ and $OV_{eq}$ values determined. The results are summarized below in Table XIV.

TABLE XIV

| | Total Reducing Sugars (%) | Total Alkaloids (%) | Chlorogenic Acid (%) | Rutin (%) |
|---|---|---|---|---|
| NON-CYLINDER TREATED TOBACCO (Comparative) | | | | |
| Before Expansion (Control) | 9.7 | 1.49 | 1.14 | 0.46 |
| After Expansion (WATER process) | | | | |
| 288° C. | 5.3 | 0.92 | — | — |
| 316° C. | 3.5 | 0.72 | — | — |
| 343° C. | 3.0 | 0.54 | — | — |
| 357° C. | 2.0 | 0.30 | 0.57 | 0.11 |
| CYLINDER TREATED | | | | |
| Before Expansion (Control) | trace | 1.46 | 0.32 | 0.1 |
| After Expansion (WATER process) | | | | |
| 288° C. | trace | 1.17 | — | — |
| 316° C. | trace | 0.90 | — | — |
| 343° C. | trace | 0.60 | 0.29 | 0.1 |
| 357° C. | trace | 0.42 | 0.19 | 0.1 |

We claim:

1. A process for increasing the filling power of tobacco comprising heating the tobacco at elevated temperature while maintaining the OV and SV values of the tobacco substantially constant.

2. The process of claim 1 wherein the tobacco is heated at a temperature of at least about 80° C. for a time sufficient to increase the CV value of the tobacco.

3. A process for increasing the filling power of tobacco comprising heating the tobacco at a temperature within the range of from about 80° C. to about 150° C. for a time sufficient to increase the CV value of the tobacco while maintaining the OV and SV values of the tobacco substantially constant.

4. The process of claim 3 wherein the untreated tobacco has an OV value within the range of from about 4% to about 35%.

5. A process for increasing the filling power of tobacco comprising heating tobacco having an OV value within the range of from about 4% to about 35% in a closed system at a temperature within the range of from about 80° C. to about 150° C. for a time sufficient to increase the CV value of the tobacco while maintaining the OV and SV values of the tobacco substantially constant.

6. The process of claim 4 or 5 wherein the OV value is within the range of from about 10% to about 16%.

7. The process of claim 3 or 5 wherein the tobacco is heated at a temperature within the range of from about 90° C. to about 125° C.

8. The process of claim 7 wherein the tobacco is heated for from about 6 to about 48 hours.

9. The process of claim 1, 3 or 5 wherein the tobacco is selected from the group consisting of unexpanded bright, unexoanded cased bright, expanded bright, expanded cased bright, unexpanded cased Burley, unexpanded Burley, expanded cased Burley, expanded Burley, unexpanded Oriental, unexpanded cased Oriental, expanded Oriental, expanded cased Oriental, reconstituted tobacco and mixtures thereof.

10. The process of claim 9 wherein the tobacco is selected from the group consisting of unexpanded bright. unexpanded Burley, unexpanded Oriental and mixtures thereof.

11. The process of claim 10 including, as a subsequent step, expanding the tobacco.

12. The process of claim 11 wherein the expansion step is effected according to a WATER process.

13. A tobacco product produced according to the process of claim 1, 3 or 5.

14. A process for increasing the filling power of tobacco comprising heating the tobacco at elevated temperature while maintaining the OV and SV values of the tobacco substantially constant, wherein the tobacco is selected from the group consisting of unexpanded Burley, expanded Burley, and mixtures thereof, and including, as a first step, adding a reducing sugar to the Burley in an amount such that the treated Burley contains concentration of the reducing sugar with the range of from about 3% to about 25% by weight.

15. A process for increasing the filling power of tobacco comprising heating the tobacco at a temperature within the range of from about 80° C. to about 150° C. for a time sufficient to increase the CV value of the tobacco while maintaining the OV and SV values of the tobacco substantially constant, wherein the tobacco is selected from the group consisting of unexpanded Burley, expanded Burley, and mixtures thereof, and including, as a first step, adding a reducing sugar to the Burley in an amount such that the treated Burley contains a concentration of the reducing sugar with the range of from about 3% to about 25% by weight.

16. A process for increasing the filling power of tobacco comprising heating tobacco having an OV value within the range of from about 4% to about 35% in a closed system at a temperature within the range of from about 80° C. to about 150° C. for a time sufficient to increase the CV value of the tobacco, wherein the tobacco is selected from the group consisting of unexpanded Burley, expanded Burley, and mixtures thereof, including, as a first step, adding a reducing sugar to the Burley in an amount such that the treated Burley contains a concentration of the reducing sugar with the range of from about 3% to about 25% by weight.

17. The process of claim 14, 15, or 16 wherein the sugar is selected from the group consisting of fructose, glucose, sucrose, 2-deoxyglucose, xylose, galactose, ribose, maltose, lactose, rhamnose, arabinose, and mixtures thereof.

18. The process of claim 17 wherein the reducing sugar is selected from the group consisting of glucose, fructose, and mixtures thereof.

* * * * *

UNITED STATES PATENT AND TRADEMARK OFFICE

CERTIFICATE OF CORRECTION

PATENT NO. : 4,497,330

DATED : February 5, 1985

INVENTOR(S) : Banyasz et al.

It is certified that error appears in the above-identified patent and that said Letters Patent is hereby corrected as shown below:

Col. 8, line 22, "tobacc" should be --tobacco--

Col. 9, line 53, "on" should be --one--

Col. 10, line 25, "oritioal" should be --critical--

Col. 13, line 62, "whereat" should be --whereas--

Col. 13, line 65, "treatmnet" should be --treatment--

Col. 15, line 66, "oorreoted" should be --corrected--

Col. 17, line 24, "indentical" should be --identical--

Col. 17, line 52, "proces" should be --process--

Col. 21, line 36, "unexoanded" should be --unexpanded--

Signed and Sealed this

*Fifteenth* Day of *July 1986*

[SEAL]

*Attest:*

DONALD J. QUIGG

*Attesting Officer*

*Commissioner of Patents and Trademarks*